US005231330A

United States Patent [19]

Karsten

[11] Patent Number: 5,231,330

[45] Date of Patent: Jul. 27, 1993

[54] DIGITAL HELIX FOR A TRAVELING-WAVE TUBE AND PROCESS FOR FABRICATION

[75] Inventor: Kenneth S. Karsten, Bethlehem, Pa.

[73] Assignee: ITT Corporation, New York, N.Y.

[21] Appl. No.: 782,391

[22] Filed: Oct. 25, 1991

[51] Int. Cl.[5] ..... H01J 23/24; H01J 25/34

[52] U.S. Cl. ..... 315/3.5; 333/162; 29/600

[58] Field of Search ..... 315/3.5, 39.3; 333/162; 330/43; 29/600

[56] References Cited

U.S. PATENT DOCUMENTS

| | | | |
|---|---|---|---|
| 3,157,847 | 11/1964 | Williams | 29/600 X |
| 3,436,690 | 4/1969 | Grolant et al. | 315/3.5 X |
| 3,504,223 | 3/1970 | Orr et al. | 315/3.5 |
| 3,505,730 | 4/1970 | Nelson | 29/600 |
| 3,654,509 | 4/1972 | Scott et al. | 315/3.5 |
| 4,647,816 | 3/1987 | Heynisch | 315/3.5 |
| 4,729,510 | 3/1988 | Landis | 333/162 |

*Primary Examiner*—Robert J. Pascal
*Assistant Examiner*—Benny T. Lee
*Attorney, Agent, or Firm*—Arthur L. Plevy; Patrick M. Hogan

[57] ABSTRACT

A traveling-wave tube, wherein the wire helix of prior art devices is replaced by a digital helix formed within a composite structure of thick or thin film substrates. The traveling-wave tube helix is formed from multiple substrate layers, each having conductive segments surrounded by insulating material. The superimposing of the substrate layers causes conductive segments from adjacent layers to partially overlap and form a continuous slow-wave structure between an input lead and an output lead, that mimics a traditional wire helix. The composite structure creation of the traveling-wave tube helix allows traveling-wave tubes to be miniaturized and increased in efficiency to point previously unachievable by traditional wire helix devices.

19 Claims, 8 Drawing Sheets

DIGITAL HELIX FOR A TRAVELING-WAVE TUBE AND PROCESS FOR FABRICATION

FIELD OF THE INVENTION

The present invention relates to traveling-wave tubes, in particular to traveling-wave tubes employing a helix which surrounds an electron beam, with the helix formed from stacked substrates forming a multi-layered composite substrate, with each substrate having a conductive pattern thereon.

BACKGROUND OF THE INVENTION

Traveling-wave tubes (TWT) have been in existence for over forty years and are well known in the art. Traveling-wave tubes are comprised of an electron gun and collector positioned at opposite ends of a vacuum tube. The path of the electron beam, from the gun to the collector, is surrounded by a slow wave structure through which a RF wave is passed. The most basic structure, used in traveling-wave tubes, is a helix, wherein a wire is symmetrically wound around the path of the electron beam. The RF wave passing into the input of the helix has a known frequency. The velocity of the electron beam is adjusted in the traveling-wave tube so that the electron beam has approximately the same axial phase velocity as is present within the RF wave passing through the helix. The helix acts to slow the RF wave to a velocity reasonably obtainable by the electron beam. The longitudinal component of the electromagnetic field created by the slowed RF wave interacts with the electrons of the electron beam that have an approximate synchronism. The interaction between the electron beam and the slowed RF wave causes the electron beam to slow. The energy lost in the velocity of the electron beam, through the conservation of energy, produces an increase in the energy of the slow RF wave.

Obviously, the length and the number of windings of the helix surrounding the electron beam have a large effect on the performance of the TWT. Similarly, the acceleration potential, current and power of the electron beam also control the TWT's performance. In a TWT as the accelerating potential of the electron beam is reduced, the electron beam current must be proportionally increased to maintain the same electron beam power. The decrease voltage changes the frequency of operation of the TWT. In order to compensate for this change, the diameter of the surrounding helix must be decreased and the number of windings must be increased. Consequently, in order to maintain the same frequency of operation for the traveling-wave tube, a reduction of acceleration potential of the electron beam must be accompanied by a change in the size and shape of the helical windings.

Also, as the required frequency range increases above 40 GHz, the complexity of the fabrication of wide band helix TWTs is increased for reasonable accelerating potentials, as the frequency increases helix turns per inch increase, and helix diameter decreases.

The helix diameter and helix pitch of the traveling-wave tube circuit are limited by the present technology. Currently, the state of the art for miniature traveling-wave tube helical windings employs a 0.0025 inch diameter wire, wound around a 0.025 inch mandrel at a pitch of one hundred turns per inch. The technology to economically and efficiently reduce these dimensions further, in order to create low voltage designs for use with high current density electron beams and millimeter wave performance, is difficult and complicated. The invention can be employed in the frequency range of 18 GHz to 125 GHz, but once the frequency of operation exceeds beyond 40 GHz the present technology employing wire wound helices is extremely limiting.

The present invention eliminates the need for wire coil windings through the use of thick or thin film technology. By selectively placing segments of conductive material onto substrate layers and superimposing or stacking those substrate layers such that a segment of conductive material from one layer contacts the conductive segments of adjacent layers, a helix is formed that, by design, can be much smaller than conventional wire wound helical devices. The smaller dimensioned helix permits small traveling-wave tubes to be efficiently manufactured. With appropriate processing, the digital helix TWT can be incorporated into a monolithic design for use with integrated circuitry. The resultant tubes use very low voltage with high current density electron beams. Easily manufactured millimeter wave designs are also possible. Lower power amplifiers as a front end and some on chip power conditioning can be included on a multi-function hybrid or monolithic circuit. Digital phase and gain control of the TWT is also possible monolithically.

The creation of a helical structure employing substrate technology provides unique advantages over the prior art TWTs. While the prior art has employed multiple substrate layers to provide various structures, the prior art has not been directed to TWTs or the resultant problems in the miniaturization of TWTs. See U.S. Pat. No. 4,729,510 to Landis entitled COAXIAL SHIELDED HELICAL DELAY LINE AND PROCESS, issued Mar. 8, 1988, for a typical prior art structure using multiple substrate layers.

It is therefore an object of the present invention to provide a traveling-wave tube that has a unique helical structure surrounding the electron beam, which structure is formed by employing consecutive layers of thick or thin film substrates having predetermined conductive configurations deposited thereon.

SUMMARY OF THE INVENTION

Certain problems associated with conventional TWT helices and the techniques used for making them are overcome by the present invention which includes a helix for a TWT, which helix is formed from superimposed substrate layers. The helix is formed by stacking preformed substrate layers of different sizes in such a manner that a hollow opening (hereinafter described as a "hollow") is formed through the final composite structure. Conductive material segments are positioned on each substrate layer. As the substrate layers are superimposed on top of one another, the conductive material segments partially overlap, forming a conductive helix in the final composite structure that surrounds the hollow. When an electron beam is passed through the hollow, the substrate formed helix acts in the same manner as traditional wire wound helices. As a result, a TWT helix is provided that can be miniaturized beyond the conventional limits of wire wound helices. A method for making the TWT helix includes creating parallel substrate layers, forming conductive material segments on the substrate layers, superimposing the substrate layers creating a hollow wherein the conductive material of adjacent layers partially overlaps creating a helix that surrounds the hollow.

BRIEF DESCRIPTION OF THE FIGURES

For a better understanding of present invention, reference is made to the following detailed description of an exemplary embodiment considered in conjunction with the accompanying drawings, in which.

DETAILED DESCRIPTION OF THE FIGURES

Figure 1:
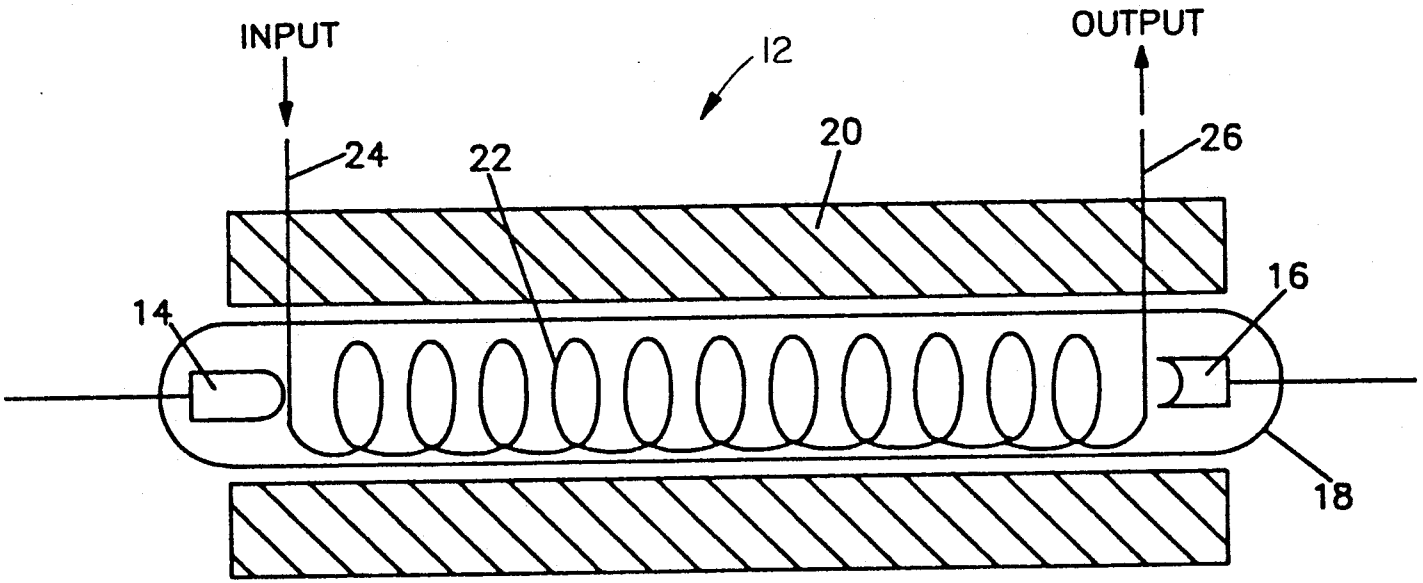
FIG. 1 PRIOR ART
FIG. 1 shows the typical prior art embodiment for a traveling-wave tube having a helical winding.

FIG. 1 refers to a typical prior art embodiment of a TWT 12. Such prior art tubes have an electron beam emitter 14 and an electron beam collector 16 encased in a tube 18 having an internal vacuum. The path of the electron beam is determined by a magnetic beam-focusing system 20, many forms of which are well known in the art. Disposed along a portion of the length of the tube 18 and positioned about the electron beam pathway is the slow wave structure which is a helix 22. The helix 22 has an input lead 24 and an output lead 26, and is fabricated from a conductive wire. The input lead 24 provides a terminal for an input signal (INPUT) that is applied to the TWT 12, while output lead 26 provides a terminal for receiving an output signal (OUTPUT) from the TWT 12.

Figure 2:
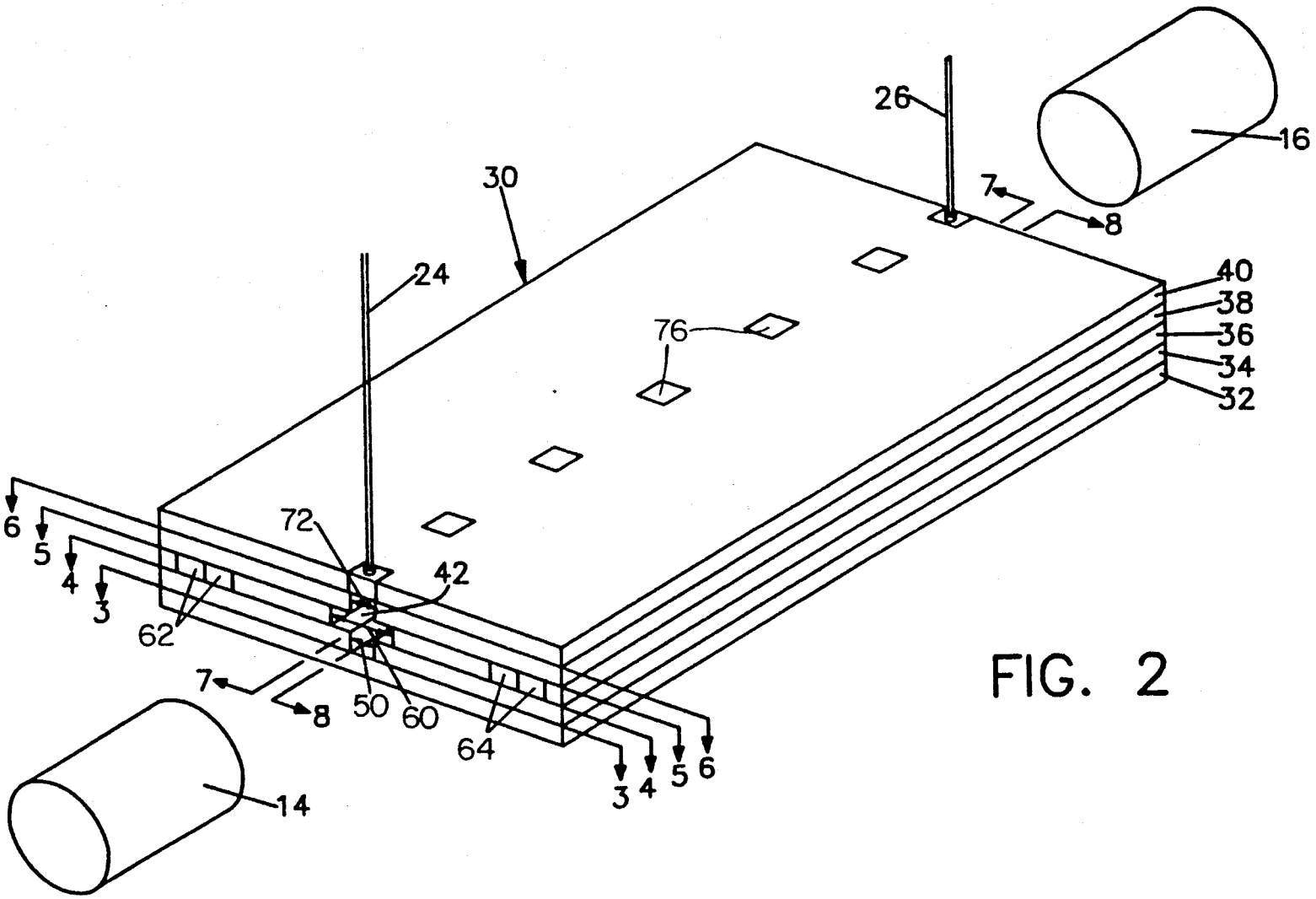
FIG. 2 shows an exploded perspective view of an embodiment of a layered substrate traveling-wave tube structure according to this invention.

Referring to FIG. 2, the helix 22 of the prior art TWT circuit is replaced by a thick or thin film helix embedded in a composite structure 30 formed from the superimposing of layers 32, 34, 36, 38, 40 of insulated substrate material having prepositioned segments of conductive material located thereon. The forming of such substrate layers 32, 34, 36, 38, 40 is well known in the arts of thick film and thin film substrate manufacturing. See a text entitled "Microelectronics", by Max Foyiel, published by Research & Education Associates, (1968), where thin and thick film techniques are described. When the substrate layers 32, 34, 36, 38, 40, are superimposed over one another, the conductive segments present on adjacent layers overlap in a building block fashion that forms a digital helix, mimicking the wire helix of traditional traveling-wave tubes. Since the digital helix is built in a building block fashion, the resolution of the curvature of the turns of the digital helix are determined by the size and number of superimposed conductive segments that create the digital helix. The term "digital" is used to convey the concept that the helix is not a continuous arculate structure but rather a stepped structure implying a digital rather than a true analog device. An input lead 24 extends above the composite structure 30 through which an input signal can be supplied to the internal digital helix. Similarly, an output signal lead 26 extends above the composite structure 30 at its opposite end, to provide a terminal for receiving an output signal from the digital helix. The composite structure 30 has a hollow 42 formed through it, for the passage of an electron beam, from the emitter 14 to the collector 16. The hollow 42 can be made by stacking variously dimensioned substrate layers in such a manner as to create the hollow 42 (as is shown), or by cutting the hollow 42 through the composite structure 30 after its formation, or by using photo resist/lithography and chemical etch as is well known in the prior art.

Figure 3:
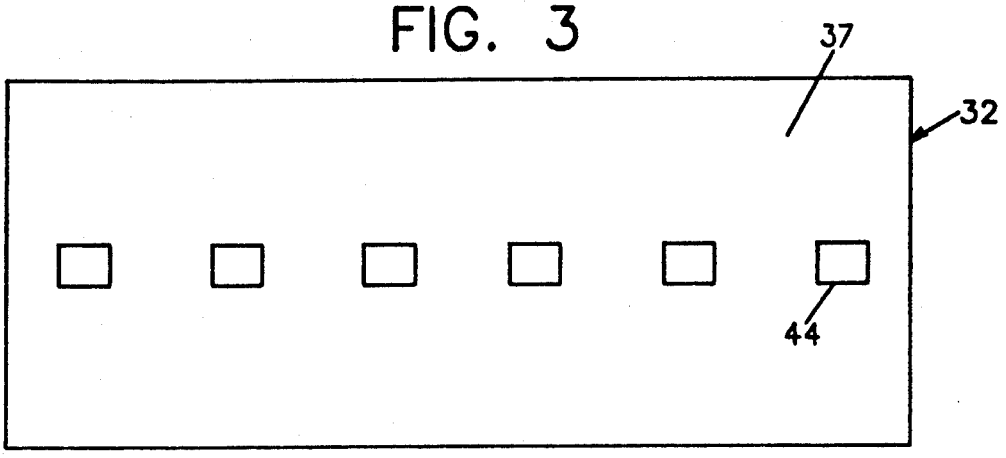
FIG. 3 shows a first substrate layer sectioned along line 3—3 of FIG. 2 and viewed in the direction of the section arrows.

The composite structure 30 is made of individual substrate layers 32, 34, 36, 38, 40 as depicted in FIGS. 2 through 6, respectively. Referring to FIGS. 2 through 6, the positionings of the conductive material on each substrate layer 32, 34, 36, 38, 40 in forming the digital helix and the hollow 42 is detailed. FIG. 3 shows the base substrate layer 32 of the composite structure 30. On the base layer 32 are a plurality of conductive segments 44, placed in a linear orientation. Each base layer conductive segment 44 is surrounded by insulating material 37 such as a silicon nitride.

Figure 4:
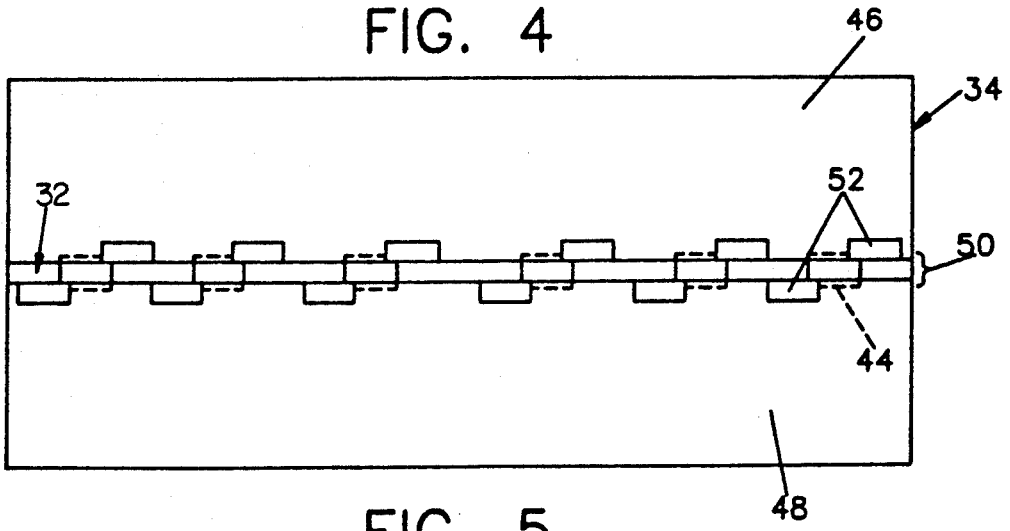
FIG. 4 shows a second substrate layer sectioned along line 4—4 of FIG. 2 and viewed in the direction of the section arrows.

Superimposed or grown directly above the base substrate layer 32 is a second substrate layer 34 (shown in FIG. 4). The second substrate layer 34 is divided into two sections 46, 48. The two sections 46, 48 create a second layer gap space 50, directly above the conductive segments 44 formed on the below lying base layer 32. The second layer gap partially exposes each of the base substrate layer conductive segments 44. A plurality of second layer conductive segments 52 are positioned along the edges of the two sections 46, 48 that face the second layer gap space 50. Two second layer conductive segments 52 partially overlap an associated base layer conductive segment 44, creating a plurality of electrically conductive pathways.

A third substrate layer 36 (shown in FIG. 5) is placed or formed over the base substrate layer 32 and the second substrate layer 34. The third substrate layer is comprised of two individual segments 54, 58 that have a smaller width than the underlying second layer segments 46, 48. The third layer segments 54, 58 are positioned atop the second substrate layer 34, creating a third layer gap space 60 that is larger than the underlying second layer gap space 50. The third layer gap space 60 exposes the underlying second layer gap space 50 and partially exposes the second layer conductive segments 52. The third layer gap space 60 thereby leaves the base layer conductive segments 44 exposed below the second substrate layer 34. A plurality of third layer conductive segments 56 line the edges of the third layer sections 54, 58 that face the third layer gap space 60. Each third layer conductive segment 56 partially overlaps an associated second layer conductive segment 52, forming the different parts of the digital helix from the base substrate layer 32 through the third substrate layer 36.

The third substrate layer 36 also includes bands of conductive material 62, 64 that run parallel to the third layer conductive segments, and span the entire length of third substrate layer 36. The function of the conductive bands 62, 64 will be discussed later in this specification.

Figure 5:
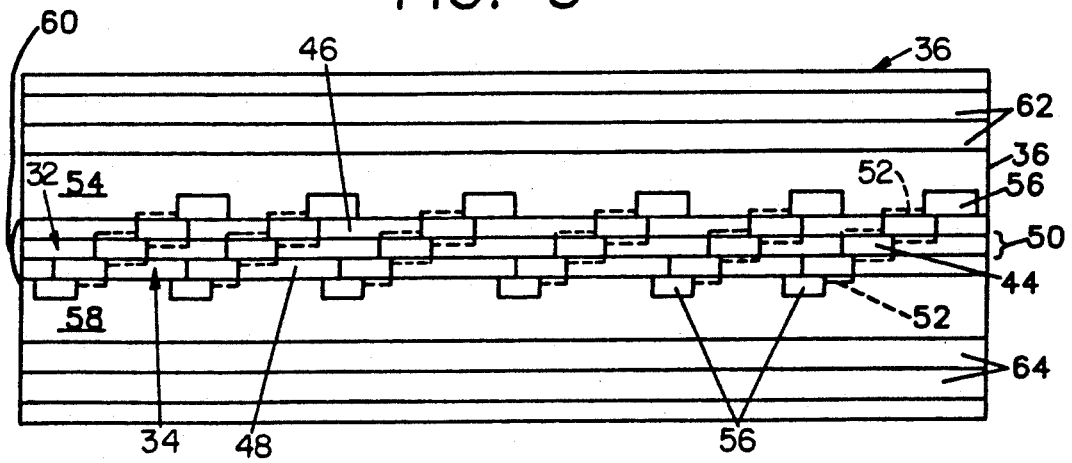
FIG. 5 shows a third substrate layer sectioned along line 5—5 of FIG. 2 and viewed in the direction of the section arrows.
Figure 6:
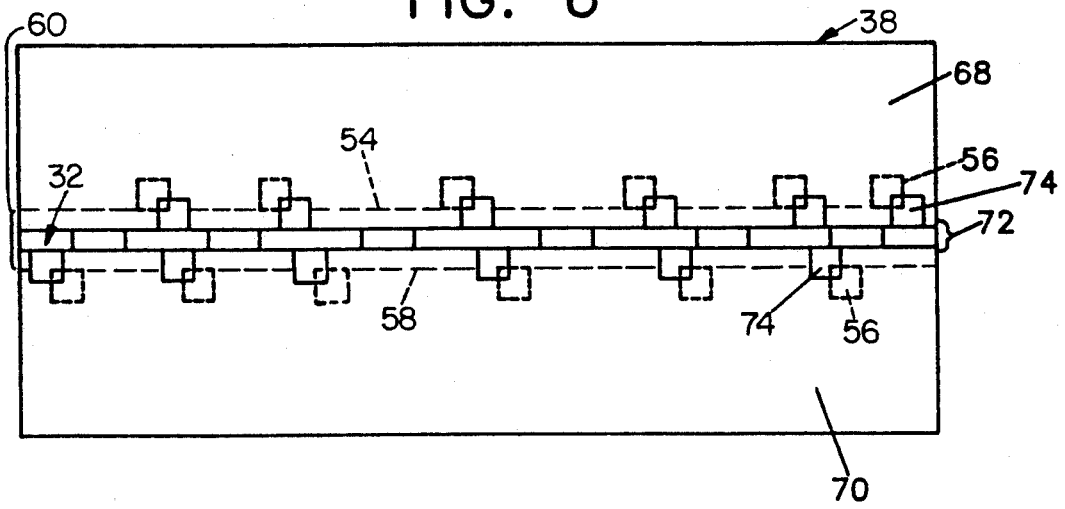
FIG. 6 shows a fourth substrate layer sectioned along line 6—6 of FIG. 2 and viewed in the direction of the section arrows.

A fourth substrate layer 38 (shown in FIG. 6) is placed, positioned or formed atop the below lying third substrate layer 36 (shown in FIG. 5). The fourth substrate layer 38 is made of two sections 68, 70, that are larger than the underlying third layer sections 54, 58. Consequently, when the fourth layer sections 68, 70 are placed atop the below lying substrate layer, each fourth layer sections 68, 70 overhang part of the underlying third layer gap space 60. The fourth layer sections 68, 70 do not touch; thus a fourth layer gap space 72 is created. As with previous layers, a plurality of fourth layer conductive segments 74 line the edges of the fourth layer sections 68, 70 facing the fourth layer gap space 72. Each fourth layer conductive segment 74 partially overlaps an associated third layer conductive segment 56, extending the separate turns of the digital helix from the base substrate layer 32 (shown in FIG. 3) through the fourth substrate layer 38. Since the fourth sections 68, 70 overlap the third layer gap space 60, the fourth layer conductive segments 74 are partially exposed by the underlying third layer gap space 60.

Referring back to FIG. 2, in conjunction with FIGS. 3-14 6, the top layer 40 of the composite structure 30 is shown. The top layer 40 is placed or formed over the fourth tier layer 38 covering the fourth layer gap space 72. The first, second and third gap spaces 50, 60, 72 are now enclosed between the base substrate layer 32 and the top substrate layer 40, creating the hollow 42, within the composite structure 30. A plurality of top layer conductive segments 76 are positioned so as to partially overlap two adjacent fourth layer conductive segments 74 (shown in FIG. 6). The joining of adjacent fourth layer conductive segments 74 by the top layer conductive segments 76, links the separate turns of the digital helix, creating one continuous digital helix from all the conductive segments of the respective substrate layers. The digital helix begins on the top substrate layer 40 at input lead 24 and ends on the top substrate layer 40 at output lead 26 in this example.

Figure 7:
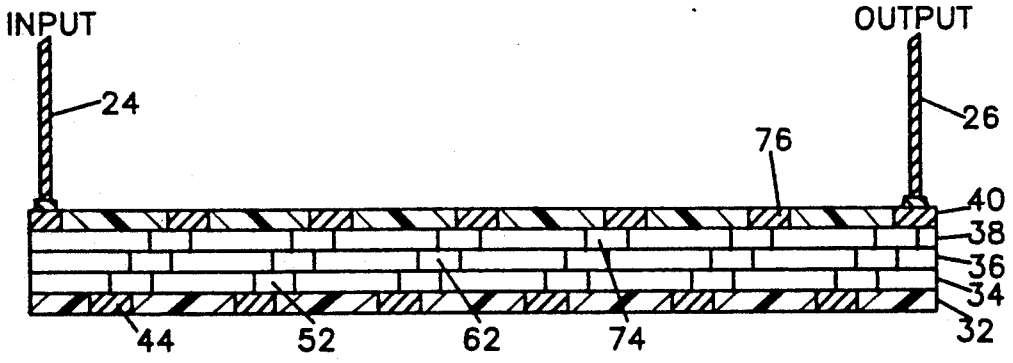
FIG. 7 shows a cross section of the layered substrate structure sectioned along line 7—7 of FIG. 2 and viewed in the direction of the section arrows.
Figure 8:
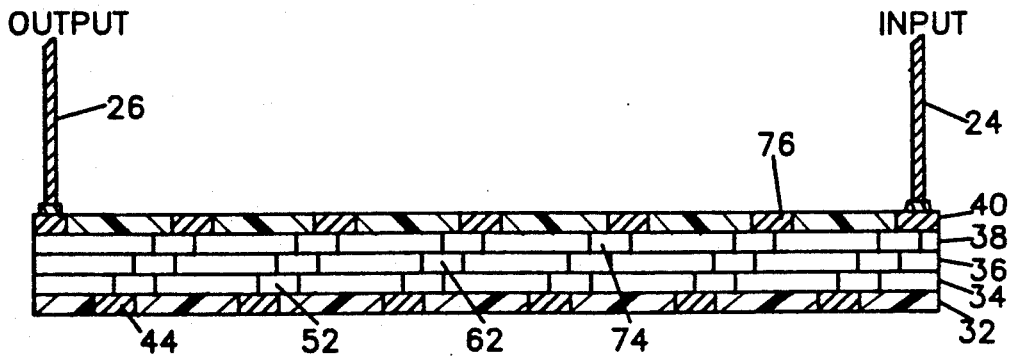
FIG. 8 shows a cross sectional view of the layered substrate structure sectioned along section line 8—8 of FIG. 2 and viewed in the direction of the section arrows.
Figure 9:
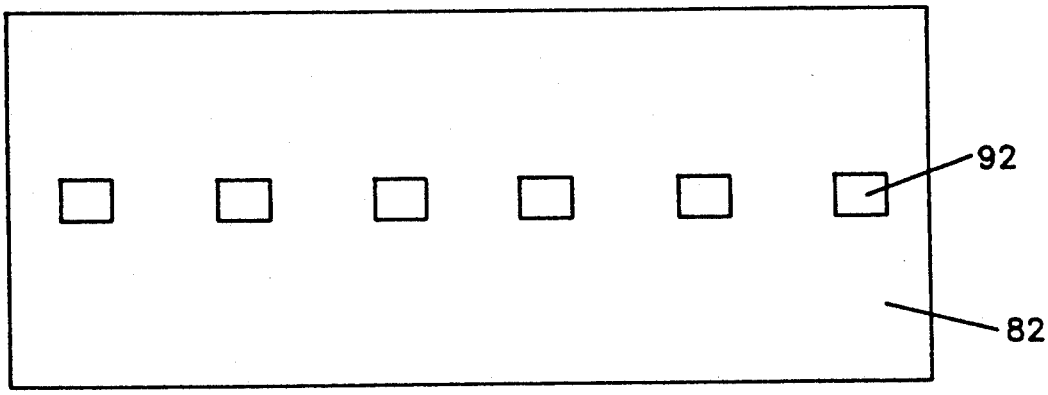
FIG. 9 shows a mask used to form the conductive elements of the base layer substrate shown in FIG. 3.
Figure 10:
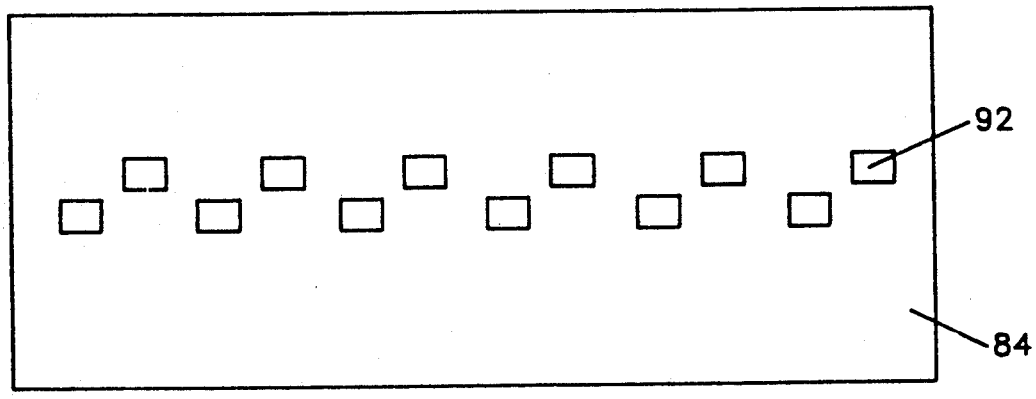
FIG. 10 shows a mask used to form the conductive elements of the second layer substrate shown in FIG. 4.
Figure 11:
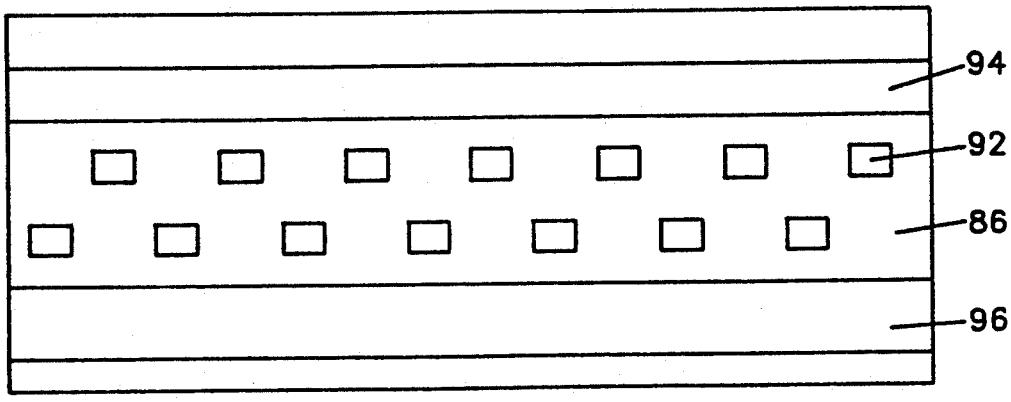
FIG. 11 shows a mask used to form the conductive elements of the third layer substrate shown in FIG. 5.
Figure 12:
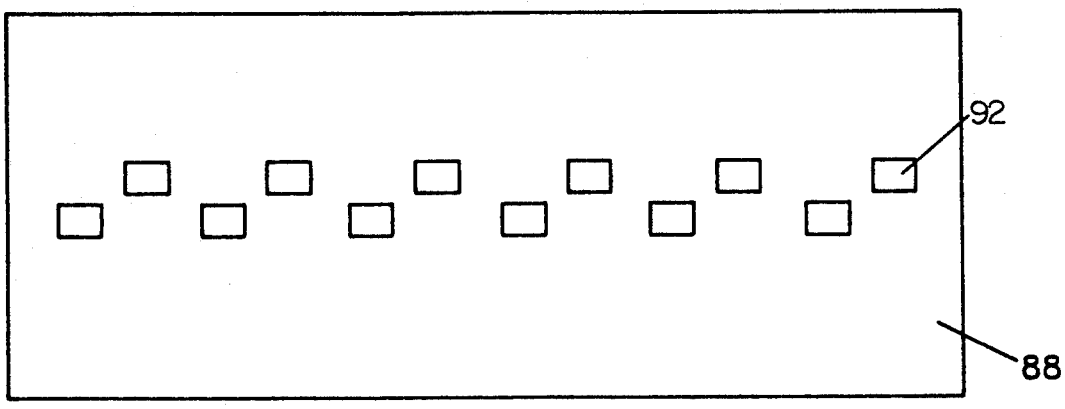
FIG. 12 shows a mask used to form the conductive elements of the fourth layer substrate shown in FIG. 6.
Figure 13:
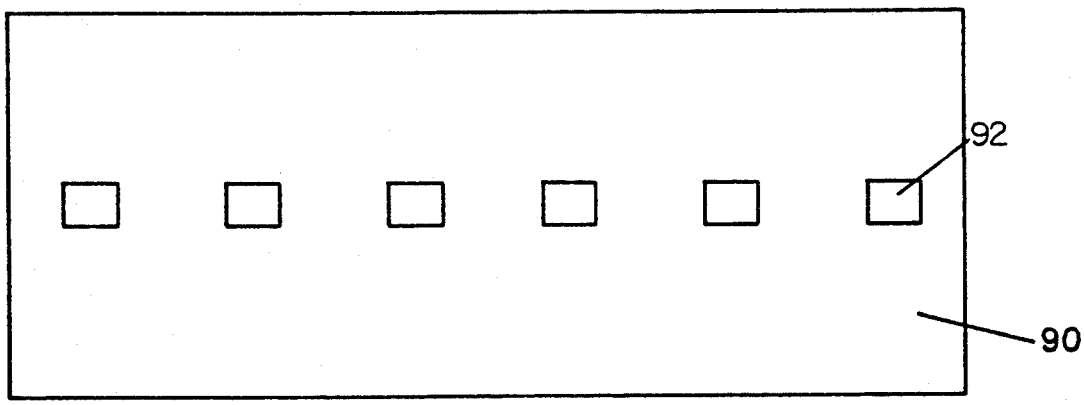
FIG. 13 shows a mask used to form the conductive elements of the top layer substrate shown in FIG. 2.

The digital helix created by the overlapping conductive segments of the various substrate layers 32, 34, 36, 38, 40 is created in a building block fashion, so that the conductive segments wind around the hollow 42, (shown in FIG. 2), formed through the composite structure 30. The hollow 42, partially exposes the conductive segments of each substrate layer as they follow along the digital helix. Referring to FIGS. 7 and 8 in unison, the digital helix created by the overlapping conductive segments is detailed. As is shown, the conductive segments 44, 52, 62, 74, 76 are continuously connected between the base substrate layer 32 and the top substrate layer 40, while following the contours of each of the substrate layers 32, 34, 36, 38, 40. The result of the positioning of the segments creates a stepped digital helix, which surrounds the hollow 42, and mimics a traditional wire helix between input lead 24 and output lead 26. It should be understood that although a five layered substrate is shown, any plurality of layers could be used in creating the substrate. Additionally, the number and size of conductive segments created on each substrate layer is limited only by the art of thick film or thin film substrate manufacturing.

By passing an electron beam through the hollow 42 of the composite structure 30, the helical progression of the conductive segments acts in the same manner as traditional a wire helix. The advantages over traditional TWTs being the ability to miniaturize the TWT helix to a previously unachievable size. Utilizing modeling software, it has been predicted that TWT helices created from thick or thin film substrates can work at efficiencies far greater than that of traditional miniature TWT wire helices.

To exemplify the advantages of the present invention TWT circuit an initial narrow band design example for 8.0 to 10.5 GHZ at 10 watts minimum has been modelled. The physical parameters of the TWT circuit are given by the below table:

| | | |
|---|---|---|
| TURNS PER INCH | 170.0 | |
| HELIX DIAMETER | 0.017 | INCH |
| TAPE WIDTH | 0.002 | INCH |
| TAPE THICKNESS | 0.002 | INCH |
| DIELECTRIC CONSTANT | 7.7 | |
| VACUUM ENVELOPE I.D. | 0.050 | INCH |
| BEAM CURRENT | 0.2 | AMPS |
| BEAM DIAMETER | 0.010 | INCH |
| ACCELERATION POTENTIAL | 500.0 | VOLTS |
| BRILLOUIN MAGNETIC FIELD | 6181.0 | GAUSS |

The above given dimensions could be fabricated with a nine layer substrate and fifty micron thick film technology. The dielectric constant for the supporting structure is assumed at 7.7 which is approximately the same for aluminum nitride substrate material and silicon nitride insulating layers. The below table, representing the performance of the modelled TWT helix achieves an output power of 10.0 watts assuming 10% electron beam conversion efficiency as a worst case. This beam conversion efficiency is typical for conventional wire wound wide band miniature TWTs. The performance of the modelled TWT helix is as follows, where C is the gain parameter of the TWT, QC is the space charge parameter and Vp/c is the phase velocity divided by the speed of light:

| FREQ (GHZ) | GAIN (dB/inch) | C | QC | Vp/c |
|---|---|---|---|---|
| 8.0 | 69.89 | 0.617 | 1.070 | 0.0940 |
| 8.5 | 123.41 | 0.626 | 0.977 | 0.0935 |
| 9.0 | 148.18 | 0.635 | 0.891 | 0.0930 |
| 9.5 | 154.47 | 0.645 | 0.812 | 0.0925 |
| 10.0 | 140.78 | 0.656 | 0.739 | 0.0920 |
| 10.5 | 94.10 | 0.667 | 0.673 | 0.0915 |

As is apparent from the above table, miniature TWT helices created from thick or thin film substrates can have very high gains per inch, resulting in very short devices. Short devices can be made at lower costs and higher volumes. Additionally, it is well known in the art that the efficiency of a TWT is directly proportional to its gain parameter C. Comparing the above modelled results with traditional X-band miniature TWTs, that have gain parameters of 0.06 to 0.09, the dramatic efficiency improvements of the present invention become apparent.

The present invention TWT could be broad banded using dispersion shaping rails, similar to those used in conventional miniature TWTs. Referring to FIGS. 2 and 5, the dispersion shaping rails can be created on the integrated circuit level directly as part of the composite structure 30. The dispersion shaping rails can be created by forming continuous bands of conductive material 62, 64 parallel to the hollow 42. It should be understood that although the embodiment illustrated shows only one layer on which the dispersion shaping rails 62, 64 are shown, the rails may exist on more than one layer in any width or thickness, depending on the broad band performance needs.

Referring to FIGS. 9 through 13, the masks 82, 84, 86, 88, 90 corresponding to the substrate layers shown in FIGS. 2 through 6, are depicted. The masks 82, 84, 86, 88, 90 can be employed for exposing individual substrates which are processed to form apertures corresponding to the conductive segment pattern on the substrates, which are metallized. Each substrate can then be superimposed, stacked or layers can be formed, one atop the other, employing well known thick and thin film techniques. For instance, the mask 82 shown in FIG. 9 has apertures formed through it. Mask 82 can be used to create the base substrate layer 32 of FIG. 3, whereby the apertures 92 correspond in position to the conductive segments formed on the base substrate layer 32. The mask 84 shown in FIG. 10 can be used to form the second substrate layer 34 of FIG. 4 over the base substrate layer 32 of FIG. 3. The apertures 92 in the mask 84 correspond to the position of conductive segments on the second substrate layer 34. The mask 86 of FIG. 11 can be used to form the third substrate layer 36 of FIG. 5 over the second substrate layer of FIG. 4. The apertures 92 in mask 86 correspond to the position of conductive segments on the third substrate layer 36. Slots 94, 96 correspond to the position of dispersion shaping rails 62, 64 on the third substrate layer 36. The mask 88 of FIG. 12 can be used to form the fourth substrate layer 38 of FIG. 6 upon the third substrate layer of FIG. 5. The apertures 92 in mask 88 correspond to the position of conductive segments on the fourth substrate layer 38. Lastly, the mask 90 of FIG. 13 can be used to form the top substrate layer 40 of FIG. 2 upon the fourth substrate layer of FIG. 6. The apertures 92 in mask 90 correspond to the position of conductive segments on the top substrate layer 40.

Figure 14:
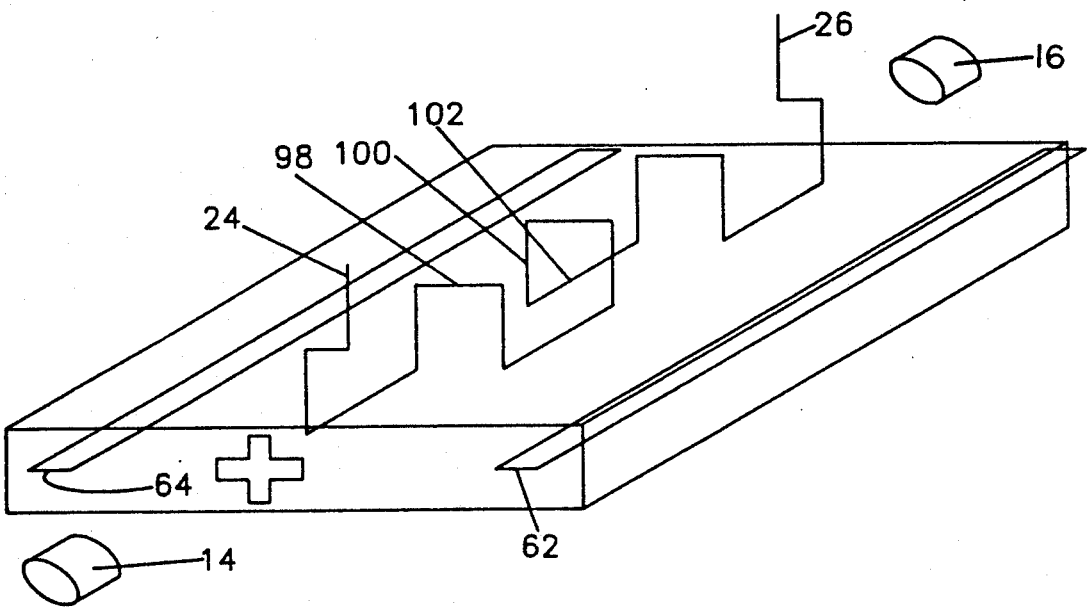
FIG. 14 shows a schematic for an alternative embodiment for the helix formed within the substrate structure.
Figure 15:
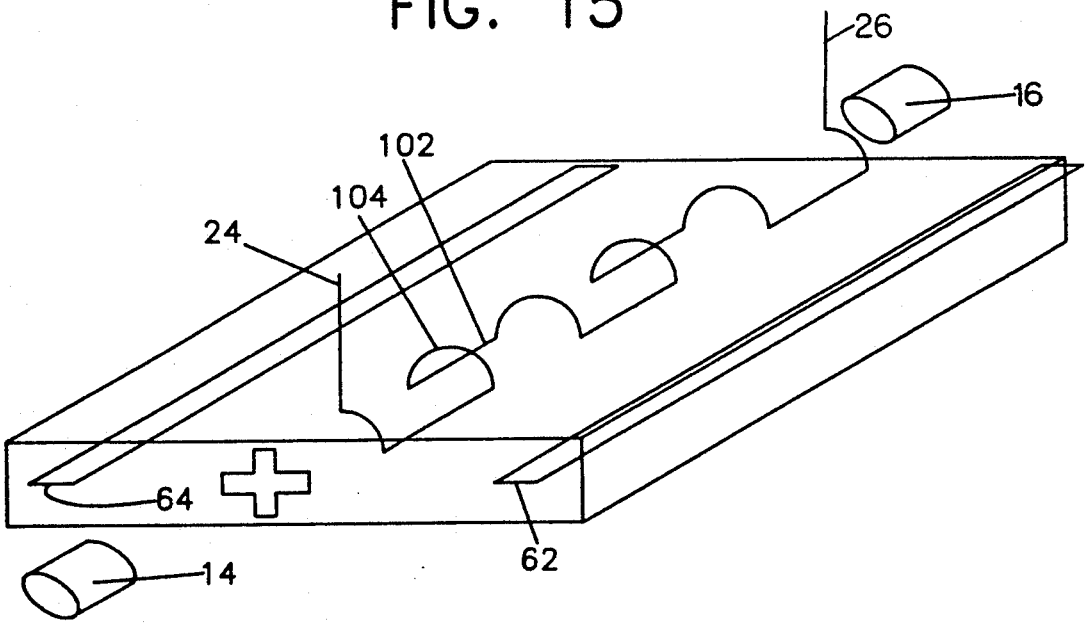
FIG. 15 shows a schematic for a second alternative embodiment for the helix formed within the substrate structure.

Referring now to FIGS. 14 and 15, three-dimensional schematic drawings for alternatively shaped TWT helices are shown that extend between an input lead 24 and an output lead 26. As is illustrated, the TWT helix need not be purely a helix in its orientation around the electron beam pathway. Rather, the TWT helix can be comprised of horizontal sections 98, vertical sections 100 and straight sections 102, as is shown in FIG. 14, or curved sections 104 and straight sections 102 as shown in FIG. 15. The building block approach the present invention uses to create a digital helix though a composite substrate 30, allows an infinite number of differing slow wave structures to be created between a cathode 14 and anode 16 by changing the thick or thin film masking elements. Such flexibility in manufacturing was previously unavailable in a wire wound TWT helix because of the time and expense involved in retooling the wire winding machine. Consequently, the present invention can be used to create TWT helices having performance characteristics previously unobtainable from wire winding technology. Such alternate embodiments may also include the dispersion shaping rails 62, 64 previously described.

Figure 16:
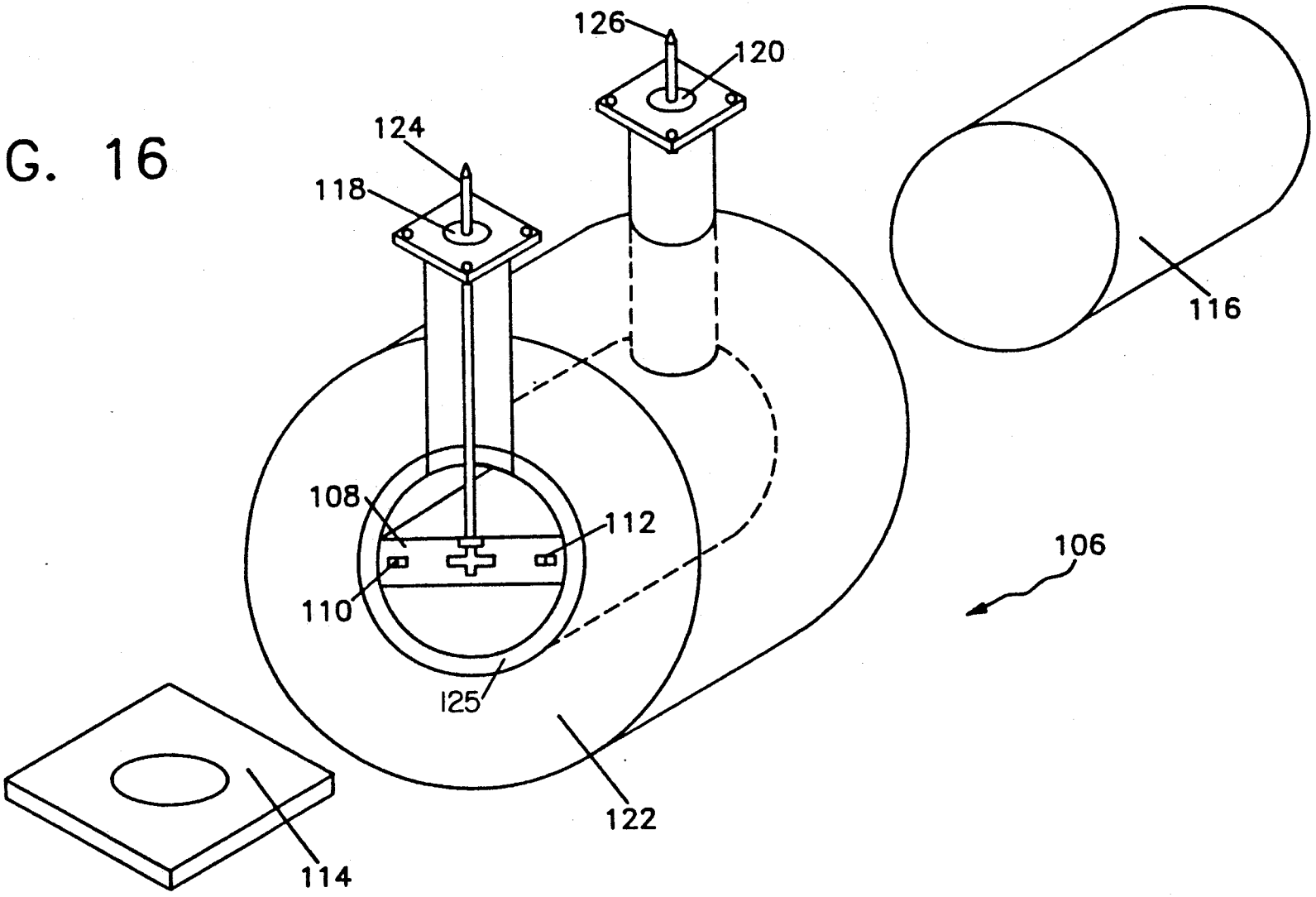
FIG. 16 shows a perspective, exploded view of a miniaturized traveling-wave tube amplifier utilizing the present invention.

Referring to FIG. 16, TWT amplifier 106 is shown that embodies the digital helix formed within the composite structure 108. The composite structure 108 includes dispersion rails 110, 112 so the amplifier 106 can perform broad band operations. A lateral or vertical gated field emitter, or high current density thermionic emitter 114, emits an electron beam that passes through the composite structure 108 to a depressed potential electron beam collector 116. The input lead 124 for the TWT helix enters the vacuum tube (not shown) through an input vacuum feed thru 118. Similarly, the output lead 126 exits the vacuum tube through a second vacuum feed thru 120. The composite structure 108 is surrounded by a vacuum cylinder wall 125. The composite structure 108 is friction fit into the cylinder as a one piece assembly. This drastically simplifies the current slow valve structure assemblies. The vacuum wall 125 is then surrounded by a high energy product permanent magnet focusing system 122 that controls the electron beam. Utilizing the embodiment of FIG. 16, it is anticipated that a TWT amplifier for a high gain (60.0 dB) device can be created that is 1.5 to 2.5 inches in length with a maximum outside diameter of 0.5 inches. Such miniaturization vastly expanding the applications for which TWT amplifiers can be applied.

Obviously, a person skilled in the art could create numerous modifications of the invention without departing from its intended scope. For example, the substrate, through which the TWT helix is formed, may be formed from seven, nine or any other number of layers. The thickness of the layers and the concentration of conductive material deposited on each layer may be varied to differing dimensions. The three-dimensional geometric configuration of the TWT helix can be changed. The size and shape of the hollow through the substrate can be changed to accommodate various sized electron beams. All such modifications are intended to be included within the spirit and scope of the invention as defined by the appended claims.

What is claimed is:

1. A slow-wave structure disposed between an electron beam emitter and an electron beam collector in a traveling-wave tube, comprising:

a composite structure including at least three superimposed dielectric substrate layers and having a hollow disposed therethrough and arranged for the passage of an electron beam emitted from said emitter to said collector, said hollow exposing at least one surface on each of said substrate layers; and a plurality of conductive material segments disposed on each of said substrate layers, wherein each of said conductive material segments are at least partially exposed to said hollow, said conductive material segments on each of said substrate layers overlapping said conductive material segments from adjacent said substrate layers, thereby defining a conductive pathway around said hollow.

2. The slow-wave structure of claim 1, wherein said conductive pathway has a generally helical shape.

3. The slow-wave structure of claim 1, wherein said substrate layers include a soil base substrate layer, a solid top substrate layer and at least one center substrate layer divided by a gap space, juxtaposed between said base substrate layer and said top substrate layer, wherein said gap space of said at least one center substrate layer creates said hollow in said composite structure.

4. The slow-wave structure of claim 1, wherein a plurality of conductive dispersion shaping rails are disposed in at least one of said substrate layers whereby said dispersion shaping rails are generally parallel to said hollow.

5. The slow-wave structure of claim 1, wherein said at least three superimposed substrate layers are thick film layers of dielectric material.

6. The slow-wave structure of claim 1, wherein said at least three superimposed substrate layers are thin film layers of dielectric material.

7. A traveling-wave tube comprising:

a tube structure having an internal vacuum and including an electron beam emitter for producing an electron beam within said tube structure and an electron collector for receiving said electron beam within said tube structure;

a magnetic focusing means surrounding said tube structure for focusing said electron beam; and a slow-wave structure surrounding at least a part of said electron beam, said slow-wave structure being embedded within at least three superimposed substrate layers of dielectric material, wherein a hollow cavity is disposed through said substrate layers through which said part of said electron beam passes.

8. The traveling-wave tube of claim 7, wherein said slow-wave structure is substantially helically shaped.

9. The traveling-wave tube of claim 8, wherein conductive material segments are disposed on each one of said substrate layers, each said conductive material segments contacting other said conductive material segments on adjacent said substrate layers creating said slow-wave structure.

10. The traveling-wave tube of claim 9, further comprising a plurality of conductive dispersion shaping rails disposed parallel to said electron beam.

11. The traveling-wave tube of claim 9, wherein said substrate layers are thick film layers of dielectric material.

12. The traveling-wave tube of claim 9, wherein said substrate layers are thin film layers of dielectric material.

13. The traveling-wave tube of claim 9, wherein each of said conductive material segments are exposed to said electron beam within said tube structure.

14. A method of forming a slow-wave structure for a traveling-wave tube, comprising:

superimposing at least three parallel substitute layers of dielectric material, each substrate layer having a plurality of conductive material segments disposed thereon, positioning said substrate layers to form a hollow therein, exposing at least one surface of each of said substrate layers, wherein said conductive material segments from adjacent substrate layers partially electrically interconnect to form a single conductive pathway around said hollow.

15. The method according to claim 14, further including the step of forming a plurality of dispersion shaping rails on at least one of said parallel substrate layers.

16. The method according to claim 14, further including positioning said plurality of conductive material segments disposed on each of said parallel substrate layers against said hollow.

17. The method according to claim 14, further including the step of forming said conductive pathway with a generally helical shape.

18. The method according to claim 14, further including the step of forming said parallel substrate layers as thick film layers of dielectric material.

19. The method according to claim 14, further including the step of forming said substrate layers as thin film layers of dielectric material.

* * * * *